US006575059B2

(12) United States Patent
Liu

(10) Patent No.: US 6,575,059 B2
(45) Date of Patent: Jun. 10, 2003

(54) WRENCH STRUCTURE

(76) Inventor: Lin-Lang Liu, PO Box 82-144, Taipei (TW)

( * ) Notice: Subject to any disclaimer, the term of this patent is extended or adjusted under 35 U.S.C. 154(b) by 0 days.

(21) Appl. No.: 09/934,673

(22) Filed: Aug. 23, 2001

(65) Prior Publication Data

US 2003/0037642 A1 Feb. 27, 2003

(51) Int. Cl.[7] ..... B25B 13/46

(52) U.S. Cl. ..... 81/60; 81/177.85; 81/63; 81/125.1

(58) Field of Search ..... 81/58, 58.2, 58.5, 81/60, 61, 177.2, 177.85, 125.1, 180.1, 185.1, 125

(56) References Cited

U.S. PATENT DOCUMENTS 1,350,315 A * 8/1920 Katzmarek ..... 81/60
2,636,411 A * 4/1953 Wood ..... 81/60
4,562,757 A * 1/1986 Furey ..... 81/63
6,006,632 A * 12/1999 Hsieh ..... 81/177.85
6,050,165 A * 4/2000 Hall ..... 81/63.1
6,336,382 B2 * 1/2002 Cerda ..... 81/60

* cited by examiner

*Primary Examiner*—D. S. Meislin
(74) *Attorney, Agent, or Firm*—Leong C. Lei

(57) ABSTRACT

An improved structure of the wrench is disclosed. The wrench relates generally to the end of the handle which is mounted with an open jaw module. The open jaw module has an end protrusion of the handle relatively provided with a smaller path of an insert lever, wherein and an open jaw is mounted. The end of the open jaw is formed into an insert recess of the inset lever. In accordance with the above mentioned specific structure design, the user will may change the size of the open jaw according to his/her size requirements.

1 Claim, 6 Drawing Sheets

WRENCH STRUCTURE

BACKGROUND OF THE INVENTION (1) Field of the Invention

The present invention relates to a wrench, and in particular, a wrench which can be used with different size standards so as to release its carrying weight, reduce cost and increase its economic efficiency.

(2) Description of the Prior Art

A wrench relates generally to a tool used for dismantling studs or nuts. It comprises an open type, a hexagon type and a sleeve type. The different standards and combinations will solely depend on studs and nuts sizes as shown in FIG. 1. The wrench has one end of he handle 10 formed into an open end 15. The other end of the handle 10 is mounted with a ratchet sleeve module 20, and a sleeve 21 is provided. The external edge of the sleeve 21 can cap a stud or a nut forms into a ratchet face 22. The handle 10 relative to one internal edge of the ratchet sleeve 20 is provided with a retainer 23 which is placed into a smaller ratchet block 24. The ratchet block 24 is supported behind with a spring element 25. When the wrench is turning in a clockwise direction, the highest point of the ratchet block 24 can engage with the ratchet face 22 of the sleeve 21 so that the sleeve 21 can tun the stud or the nut. Otherwise, when the wrench is turned in the reverse; the ratchet face 22 of the sleeve 21 will push the ratchet block 24 to move towards a slightly larger side of the retainer 23 so that the sleeve 21 will not be restricted by the ratchet block 24 and it becomes an ineffective turn. Thus, it is convenient in operation for the user. However, the application for the conventional wrench as above mentioned currently has the following problems:

(a) Common Use Being Poor

The current wrench, whether it relates to the open end 15 or the sleeve 21, has a fixed size standard, and is unable to make any change. Therefore, the user must carry a number of modules and different size standards of wrenches when in application. It will increase the expenses and the weight to carry for the user. Moreover, if any one end of the wrench is damaged then a completely new wrench is required.

(b) Lesser Torsion Force

The current ratchet block 24 is engaged with a ratchet face 22 of the sleeve 21 which is restricted by an arc protrusion design of the ratchet block 24. Whenever the wrench is tuning, the sleeve 21 and the ratchet block 24 can only provide a single engagement. It is very obvious that its torque is not strong enough which always causes damage to the ratchet lace 22 or the ratchet block 24, and will increase the frequency of repairing and changing.

SUMMARY OF THE INVENTION

Accordingly, it is an object of the present invention to provide the following technical means to achieve the above-mentioned purpose. The wrench has two ends of the handle being separately mounted with an open jaw module and a sleeve module, wherein the open jaw module has the end protrusion of the handle relatively provided with a smaller path of an insert lever, and an open jaw is mounted. The end of the open jaw is relatively formed into an insert recess of the insert lever.

The sleeve module has another end of the handle to form into a collar. The internal diameter of the bottom edge protrusion of the collar has a resist edge. The collar is provided wit the resist edge to be placed and is mounted with an external circumference of the ratchet face of the sleeve. The handle corresponds to the internal diameter of the collar formed into a joint to the crescent recess. Behind the crescent recess a retainer is also extended; and the crescent recess is mounted within a crescent ratchet block. The crescent ratchet block corresponds to the engaging gear and the curving of the ratchet face. The crescent ratchet block and the bottom edge of the retainer are secured with a recovery spring Therefore, the user will change the appropriate standard of the open jaw or the sleeve depending on his or her requirement Further, it can improve its sleeve torque and reduce its damages.

These and other advantages of the present invention will become clear to those skilled in the art upon a study of the detailed description of the invention and of the several figures of the drawings.

DETAILED DESCRIPTION OF THE PRESENT INVENTION

Figure 1:
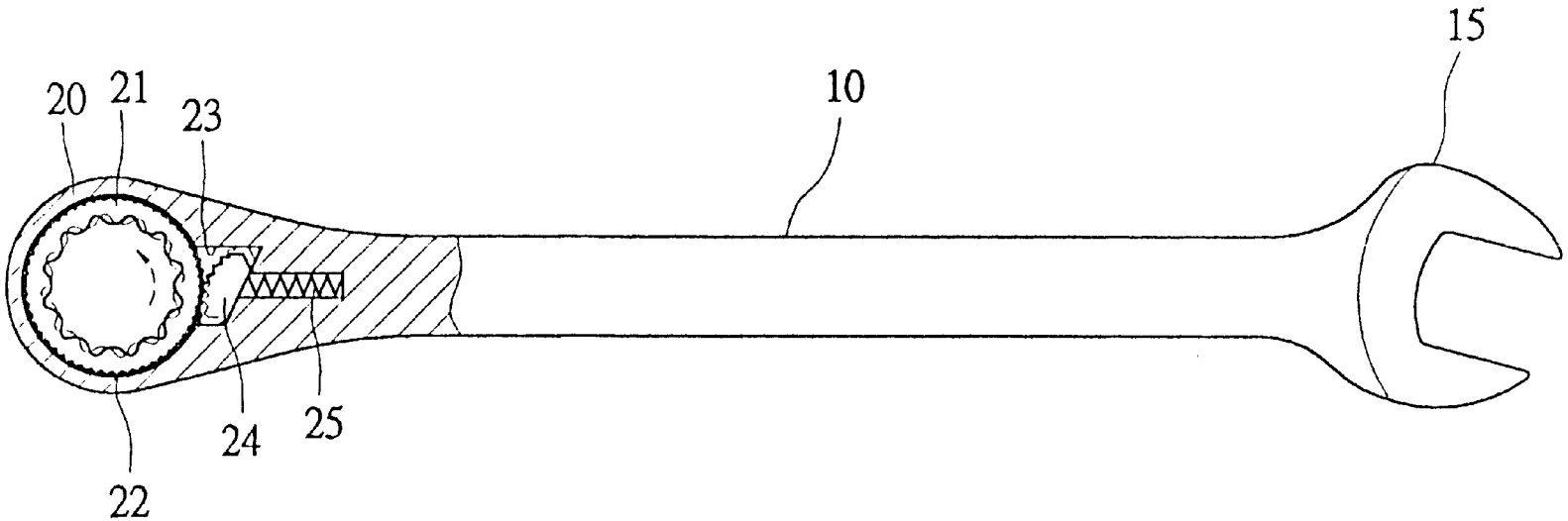
PRIOR ART FIG. 1
FIG. 1 is the plan view of the conventional wrench
Figure 2:
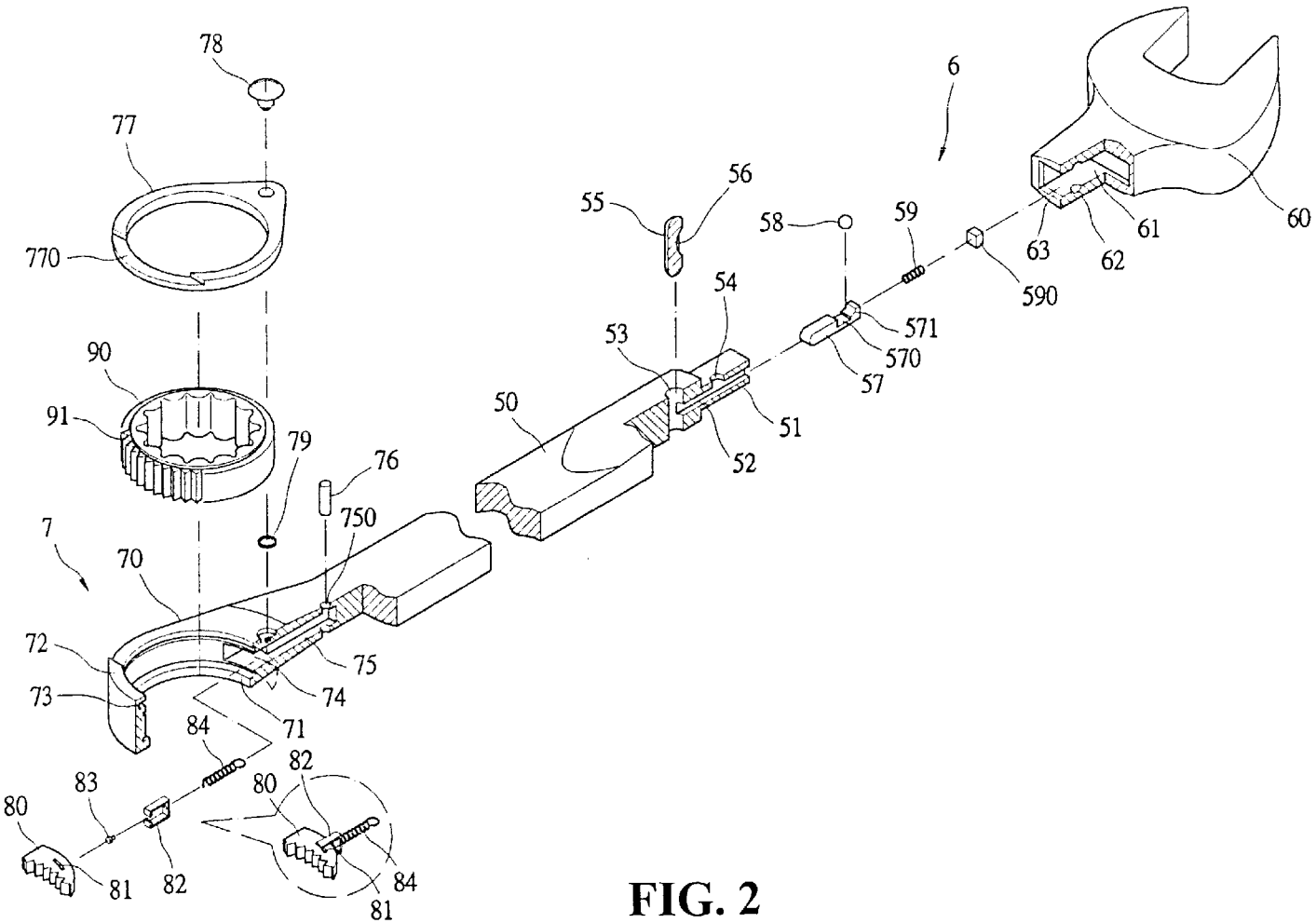
FIG. 2 is the perspective exploded view showing the components and its related relation of the present invention.

The present invention relates generally to an improved structure of a wrench that can increase its application scope and improve its torque, as shown in FIG. 2. The wrench has two ends of the handle being separately mounted with an open jaw module 6 and a sleeve module 7; wherein the open jaw module 6 and the sleeve module 7 are changeable for the different size standard of a wrench.

Figure 3A:
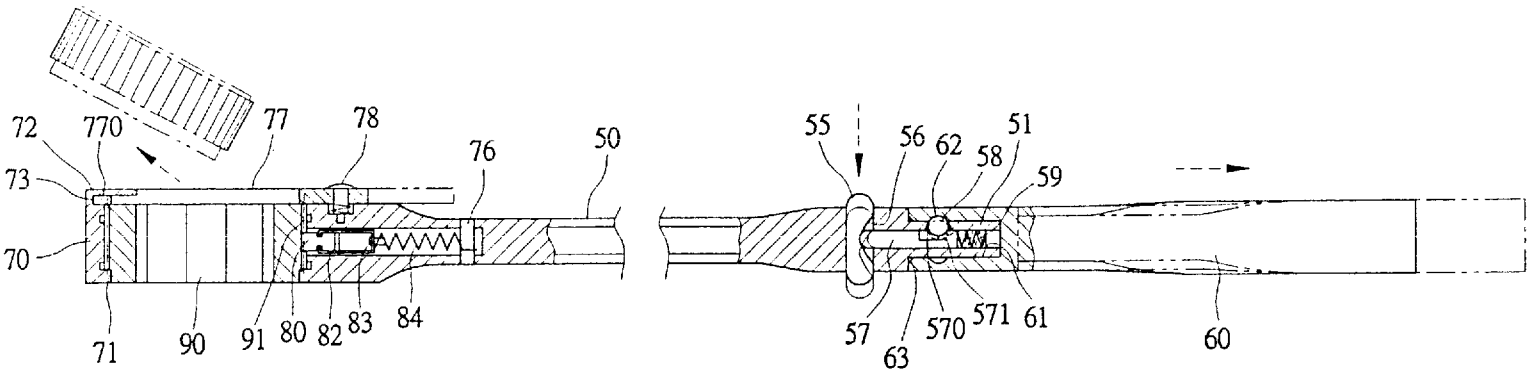
FIG. 3 is the (A) side and (B) partial front view showing the replacement for the open jaw or the sleeve.

The open jaw module 6 has the end protrusion of the handle 50 provided with a smaller path of an inset lever 51. The handle 50 is at the center along the axis of the insert lever 51, wherein a slip recess 52 is provided to slide with a supporting block 57. The insert lever 51 relative to the slip recess 52 forms into a joint to the through hole 54. The handle 50 corresponds the internal edge of the slip recess 52 which is formed into a path to meet the insert hole 53. The insert hole 53 is smooth, and is mounted with a position tap 55. The position tap 55 corresponds to the external edge of the slip recess 52, and formed into a semi-sphere of an urging recess 56. The arced protrusion edge of the supporting block 57 is slotted part-way into the urging recess 56. The supporting block 57 relative to the through hole 54 forms into a give way recess 570. The shape of the give way recess 570 is different from the lateral side of the position tap 55, in that it is formed as an enlarging slant 571. The give way recess 570 is provided with a position steel ball 58, and this position steel ball 58 has a slightly protrusion through hole 54. The radius of the position steel ball 58 is slightly smaller than the through hole 54 so as not to fill out. When corresponding to another end support of the slip recess 52, the supporting block 57 has a recovery clement 59, and a confined block 590 is fastened with the open end of the slip recess 52. The supporting block 57 is restricted within the slip recess 52 and is forced to move as shown in FIG. 3A.

The insert lever 51 is provided with an open jaw 60 which has a different size standard. At the end of the open jaw 60, an insert recess 61 is provided for inserting the insert lever 51. The internal edge of the insert recess 61 corresponds to the position steel ball 58 the insert lever 51 formed into a position recess 62 (As shown in FIG. 3A) so as to improve the engagement of the open jaw 60 and the handle 50. The open circumference of the insert recess 61 is separately formed into a slanting guiding edge 63 for inserting of the insert lever 51.

As mentioned above, the stone of the handle 50, the insert lever 51 and the insert recess 61 of the open jaw 60 are interchangeable and achieve the same outcome.

Figure 3B:
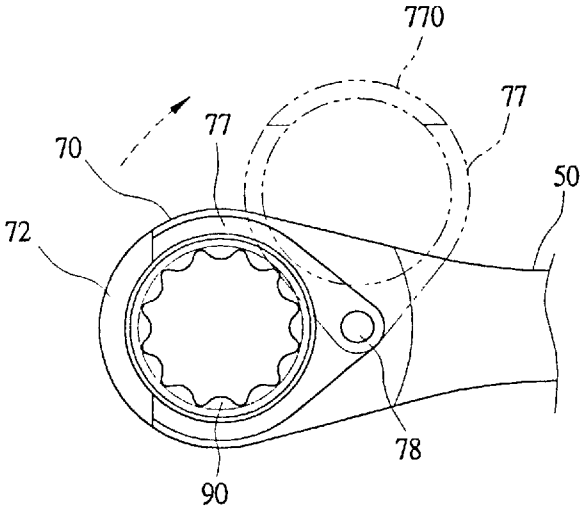

The sleeve module 7 relates to an end of the handle 50, in which a collar 70 is provided. The collar 70 is pivotally mounted with a confined plate 77, which has a smaller internal diameter. The internal diameter of the bottom end protrusion of the collar 70 has a resist edge 71 which is relatively fastened with a sleeve 90. The top face end upward protrusion of the collar 70 has a block 72 covering the groove 73. Furthermore, the handle 50 forms into a joint to the crescent recess 74, wherein a crescent ratchet block 80 is provided. A retainer 75 is extended behind the crescent recess 74. The handle 50 relative to the bottom edge of the retainer 75 forms into a path towards a joint to the through hole 750 as to provide a securing peg 76 for inserting. The confined plate 77 has a pivot peg 78 and spring 79 pivotally mounted where the handle 50 meets the collar 70 for pivotal turning (As shown in FIG. 3B). The free end of the confined plate 77, a collar 70 is provided which can insert with a protrusion clutch 770 of the groove 73 (As shown in FIG. 3A).

Both sides of the crescent ratchet block are mounted with the crescent recess 74, which is relatively formed into a slip recess 81. The slip recess 81 can be slip locked with a C-shaped clamp block 82. The clamp block 82 has a clamp peg 83 fastened with a spring 84. The other end of the spring 84 has a securing peg 76 fastened to the bottom edge of a retainer 75 so that the crescent ratchet block 80 can produce an automatic recovery function. The internal diameter of the sleeve 90 mounted in the collar 70 can be varied with different size standards. At the external circumference of the sleeve 90, a ratchet face 91 is provided. The ratchet face 91 corresponds to the engaging gear and the curving of the crescent ratchet block 80 so at the crescent ratchet block 80 can totally engage on the ratchet face 91 of the sleeve 90. Thus, this module forms a commonly used wrench structure with increased torsion.

According to the above specific structure design, the present invention when it is in practical application is in FIG. 3A & 3B. When a user requires changing the size of the open jaw 60 it is only necessary to press the position peg 55 on the handle 50 so that the position peg 55 will push the supporting block 57 with the rise of the internal edge of the urging recess 56. Further, the position steel ball 58 will fall inside the give way recess 570 of the supporting block 57, and then it can pull out the open jaw 60 smoothly. When the user opens the position peg 55 the supporting block 57 will reverted to its original position in accordance with the recovery element 59. Meanwhile, the slant 571 and the as edge of the give way recess 570 will push the position steel ball 58 and the position peg 55 back to its original position. When the new open jaw 60 is fitted, the insert recess 61 will cap on the insert lever 51. When the guiding edge 63 hits on the position steel ball 58 and the slanting arc 571 it will press down the position steel ball 58 so that the open jaw 60 may continue to be pulled in until the position steel ball 58 corresponds to the position recess 62. The position steel ball 58 will be reverted due to the recovery element 59 so that the open jaw can be steadily mounted on the handle 50 in order to achieve the purpose of changing the ends for different size standards and increasing its use.

Figure 4:
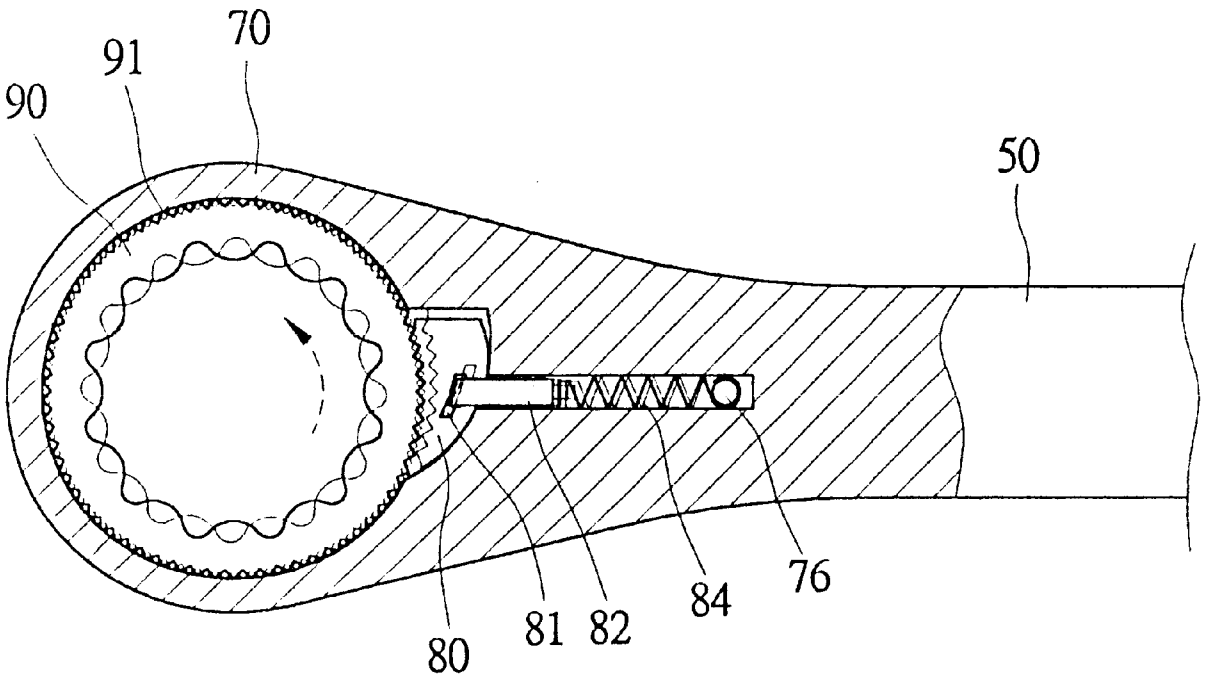
FIG. 4 is the partial front view showing the ratchet sleeve movement of the present invention.

The sleeve module 7 can be changeable, as shown in FIGS. 3 & 4. When the user requires the size of the sleeve 90 to be changed, he or she only needs to turn one side of the confined plate 77 and then take out the sleeve 90. The new sleeve 90 will be placed into the collar 70 again so that the ratchet face 91 of the sleeve 90 will engage with the crescent ratchet block 80. The confined plate 77 will ultimately be pulled back to its original position. The protrusion clutch 770 will engage with the groove 73. Thus, the different size standards of the sleeve 90 can be rapidly changed. When the user is turning a stud or nut with the sleeve module 7 in a clockwise direction, the ratchet face 91 of the sleeve 90 will let the crescent ratchet block 80 move upwards so that all gears of the crescent ratchet block 80 can totally engage with the ratchet face 91 of the sleeve 90. While it is turning it can receive larger torsion. Otherwise, when the user is turning in an anti-clockwise direction the crescent ratchet block 80 is pushed by the ratchet face 91 of the sleeve 90 and will become slightly out of orbit so that the sleeve 90 will no longer be turned effectively. This is convenient in operation for the user to turn and off-turn the wrench. Meanwhile, on the crescent ratchet block 80, a slip recess 81 is provided so that the slip motion of the crescent ratchet block 80 can be accomplished. Therefore, the clamp block 82 and the spring 84 do not require any movement so that the retainer 75 can be designed in a smaller internal diameter (as shown in FIG. 4) as it effectively increases the strength of the handle 50.

Figure 5:
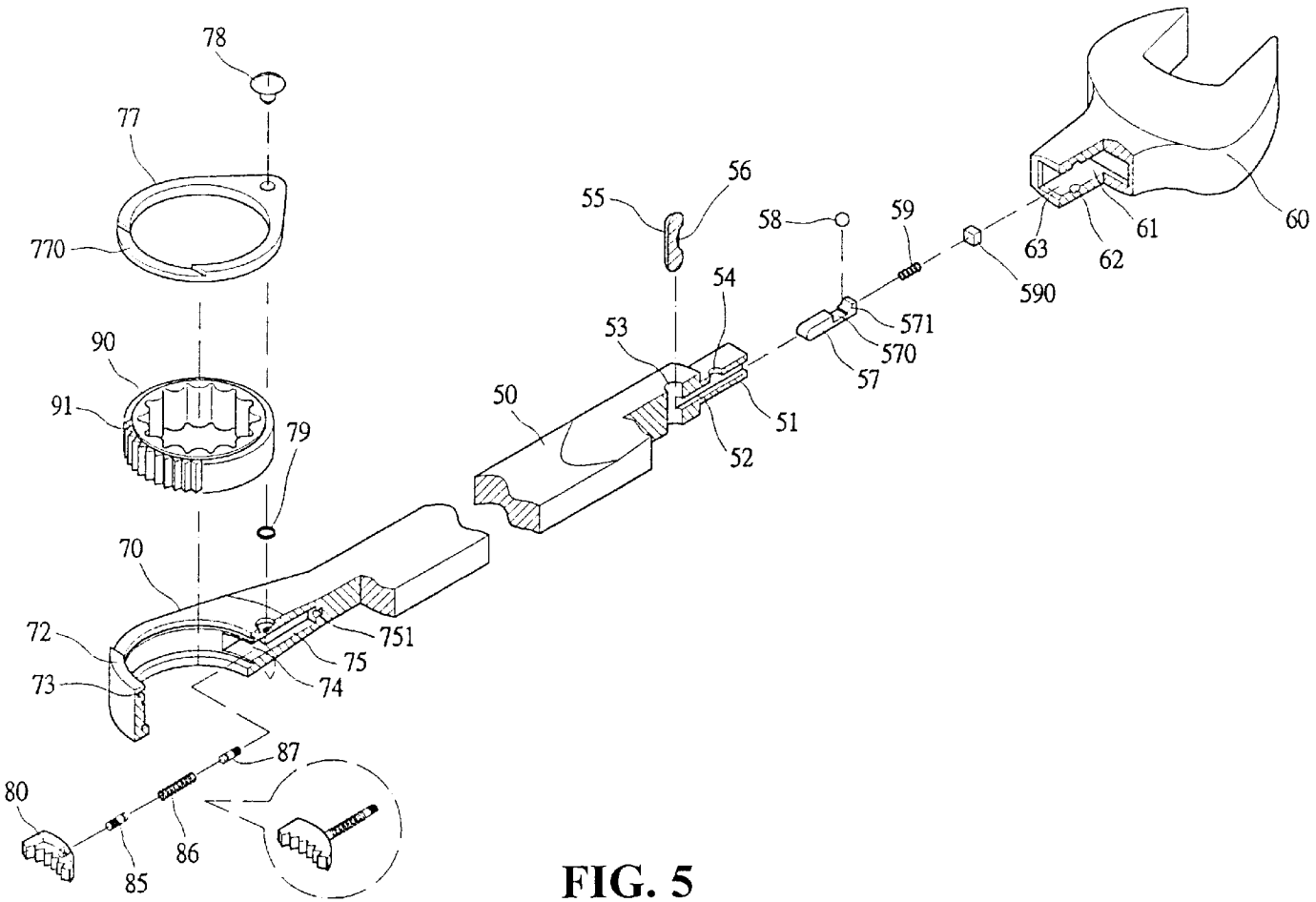
FIG. 5 is one of the preferred embodiment perspective exploded view of the present invention.

Moreover, the present invention is provided with one of the preferred embodiments as shown in FIG. 5, wherein the crescent ratchet block 80 has a securing peg 85 fastened at its bottom, and from which a spring 86 is mounted, and the other end of the spring 86 is mounted with a securing peg 87. At the bottom end of the retainer 75 of the handle 50, a peg hole 751 is provided so that the securing peg 87 can be mounted at the bottom end of the retainer. Thus, the crescent ratchet block 80 can be mounted inside the crescent recess 74 to be in conjunction with the clockwise and the anti-clockwise turning of the sleeve 90.

Figure 6:
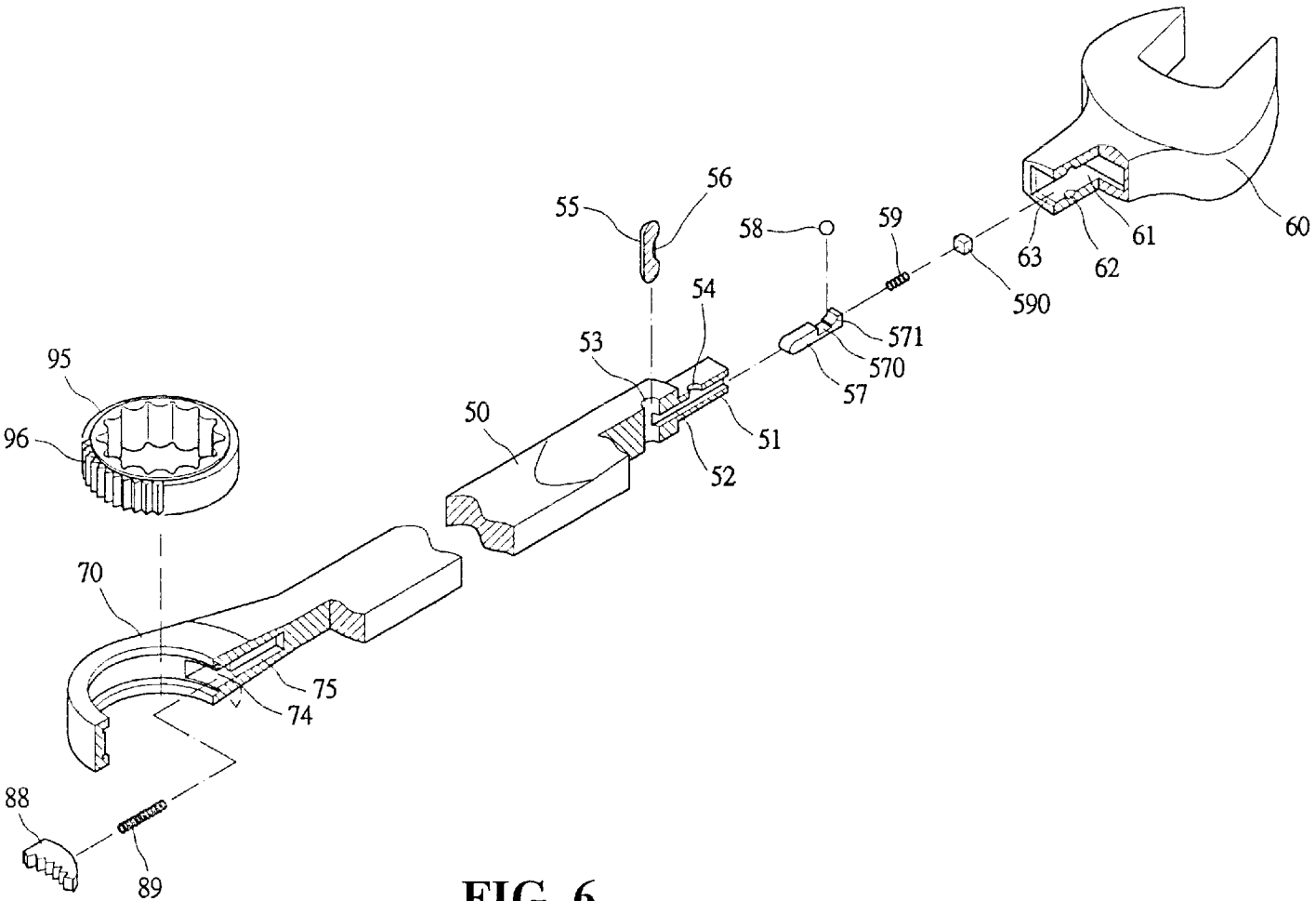
FIG. 6 is another preferred embodiment perspective exploded view of the present invention.

The present invention is provided with another preferred embodiments as shown in FIG.6. The sleeve module 7 is designed for a non-changeable type, wherein the crescent ratchet block 88 will be placed into the crescent recess 74 of the handle 50. The current ratchet block 88 is supported behind by a spring 89 in the retainer 75, which is provided for the recovery action. The external edge of the ratchet face 96 of the sleeve 90 is mounted within the collar 70 of the handle 50, and the crescent ratchet block 88 corresponds to the curving and the engaging gear of the ratchet face 96. When the wrench is turning in a clockwise direction the crescent ratchet block 88 can totally engage with the ratchet ace 96 of the sleeve 90 so it effectively raises its torque.

The preset invention provides the following further advantages:

(1) Commonly Used:

Through the present invention's specific design, the open jaw 60 or the sleeve 90 can change depending on the user's requirements. It can changed for a new one at any time and the replacing action is very convenient. Compared with the conventional fixed size wrench, the present invention is a real improvement on being able to be efficiently and commonly used.

(2) Good Torque:

Due to the specific design of the crescent ratchet block 80, when the wrench is being tuned, the crescent ratchet block 80 will let all gears be engaged with the ratchet face 91 of the sleeve 90. If compared with the conventional method, which can only be engaged with one or two gears, the present invention can effectively increase the wrenches engaging power and its overall torsion, and it does not cause damage easily.

(3) Low Cost:

As mentioned before, the present invention for the open jaw 60 and the sleeve 90 will depend on the user's requirements. In application, the user is only required to carry the handle and a series of small-sized open jaw 60 and the sleeve 90 parts. Thus, it effectively decreases the weight of wrench parts needed by the user and reduces the purchasing cost and it also reduces the repairing expenses because of its good engagement and difficulty in damaging easily. Even if damage of the open jaw 60 or the sleeve 90 occur, it only those damaged parts will need to be replace.

While the invention has been described with respect to preferred embodiment, it will be clear to those skilled in the art that modifications and improvements may be made to the invention without departing from the spirit and scope of the invention. Therefore, the invention is not to be limited by the specific illustrative embodiment, but only the scope of the appended claims.

What is claimed is:

1. A structure of a wrench comprising a handle having two ends respectively mounted with an open jaw module and a sleeve module, wherein the open jaw module and the sleeve module are changeable for different size standard of wrenches, the open jaw module has an end protrusion on the handle provided with an insert lever, a central axis of the handle is along an axis of the insert lever, wherein a slip recess in said insert lever is provided to slide with a supporting block, an internal edge of the slip recess is formed to intersect an insert hole in said end protrusion of said handle, the insert hole is smooth and is mounted with a position tap, the position tap corresponds to an external edge of the slip recess and is formed with a semi-sphere to form an urging recess, an arced protrusion edge of the supporting block extends into the urging recess, the supporting block is formed with a give way recess, a shape of the give way recess is different from a lateral side of the position tap and the give way recess is formed with an enlarging slant, the give way recess is provided with a positioning steel ball, the positioning steel ball slightly protrudes through a through hole, a radius of the position steel ball is smaller than the through hole so as not to fall out, the supporting block has a recovery element, a confined block is fastened with an open end of the slip recess, the supporting block is restricted within the slip recess and is forced to move by the recovery element, the insert lever is provided with an open jaw having a selected size, an insert recess is provided at an end of the open jaw for receiving the insert lever, an internal edge of the insert recess corresponds to the positioning steel ball, the insert lever is formed into a position recess for engaging said steel ball so as to improve engagement of the open jaw and the handle, an open circumference of the insert recess is formed into a slanting guiding edge for insertion of the insert lever, the sleeve module relates to an end of the handle on which a collar is provided, the collar is pivotally mounted with a confining plate which has a smaller internal diameter than the collar, the internal diameter of a bottom end protrusion of the collar has a resist edge which is relatively movably engaged with a sleeve, a top face end upward protrusion of the collar has a block covering a groove, the handle is formed with a crescent recess wherein a crescent ratchet block is provided, a retainer extends behind the crescent recess, the handle relative to a bottom edge of the retainer forms a through hole receiving a securing peg inserted therein, the confining plate has a pivot peg and spring pivotally mounted where the handle meets the collar for pivotal turning, a free end of the confining plate is engageable with the groove, both sides of the crescent ratchet block are mounted within the crescent recess and is formed with a slip recess which is slip locked with a C-shaped clamp block, the clamp block has a clamp peg fastened with a spring, another end of the spring has a securing peg fastened to a bottom edge of a retainer so that the crescent ratchet block can produce an automatic recovery function, an internal diameter of the sleeve mounted in the collar has a selected size, a ratchet face is provided at an external circumference of the sleeve, the ratchet face corresponds to an engaging gear and curving of the crescent ratchet block so that the crescent ratchet block can totally engage with the ratchet face of the sleeve thereby causing the sleeve module to form a wrench structure with increased torsion.

* * * * *